US008572922B2

(12) United States Patent
Pervan

(10) Patent No.: US 8,572,922 B2
(45) Date of Patent: Nov. 5, 2013

(54) MECHANICAL LOCKING OF FLOOR PANELS WITH A GLUED TONGUE

(75) Inventor: Darko Pervan, Viken (SE)

(73) Assignee: Valinge Flooring Technology AB, Viken (SE)

( * ) Notice: Subject to any disclaimer, the term of this patent is extended or adjusted under 35 U.S.C. 154(b) by 0 days.

(21) Appl. No.: 13/540,107

(22) Filed: Jul. 2, 2012

(65) Prior Publication Data

US 2013/0008117 A1 Jan. 10, 2013

Related U.S. Application Data

(60) Provisional application No. 61/504,576, filed on Jul. 5, 2011.

(30) Foreign Application Priority Data

Jul. 5, 2011 (SE) ..... 1150635
Aug. 26, 2011 (SE) ..... 1150775
Aug. 29, 2011 (SE) ..... 1150777

(51) Int. Cl.
*E04B 2/00* (2006.01)
*E04F 15/02* (2006.01)

(52) U.S. Cl.
CPC ..... *E04F 15/02* (2013.01)
USPC ..... 52/582.1

(58) Field of Classification Search
USPC ..... 52/582.1, 582.2, 586.1, 586.2, 585.1, 52/588.1
See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |
| 124,228 | A | 3/1872 | Stuart |
| 213,740 | A | 4/1879 | Conner |
| 274,354 | A | 3/1883 | McCarthy et al. |
| 316,176 | A | 4/1885 | Ransom |
| 634,581 | A | 10/1899 | Miller |
| 861,911 | A | 7/1907 | Stewart |
| 1,194,636 | A | 8/1916 | Joy |
| 1,723,306 | A | 8/1929 | Sipe |
| 1,743,492 | A | 1/1930 | Sipe |
| 1,809,393 | A | 6/1931 | Rockwell |
| 1,902,716 | A | 3/1933 | Newton |
| 2,026,511 | A | 12/1935 | Storm |
| 2,204,675 | A | 6/1940 | Grunert |
| 2,277,758 | A | 3/1942 | Hawkins |

(Continued)

FOREIGN PATENT DOCUMENTS

| | | | |
|---|---|---|---|
| CA | 2456513 | A1 | 2/2003 |
| CN | 201588375 | U | 9/2010 |

(Continued)

OTHER PUBLICATIONS

U.S. Appl. No. 13/577,042, Pervan.

(Continued)

*Primary Examiner* — William Gilbert
*Assistant Examiner* — Kyle Walraed-Sullivan
(74) *Attorney, Agent, or Firm* — Buchanan Ingersoll & Rooney P.C.

(57) ABSTRACT

A tongue (1) is shown with edge sections (3) that are used to glue the tongue into a groove (2) of panel.

19 Claims, 7 Drawing Sheets

(56) References Cited

U.S. PATENT DOCUMENTS 2,430,200 A 11/1947 Wilson
2,497,837 A 2/1950 Nelson
2,596,280 A 5/1952 Nystrom
2,732,706 A 1/1956 Friedman
2,740,167 A 4/1956 Rowley
2,863,185 A 12/1958 Riedi
2,865,058 A 12/1958 Andersson
2,872,712 A 2/1959 Brown et al.
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,271,787 A 9/1966 Clary
3,325,585 A 6/1967 Brenneman
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,720,027 A 3/1973 Christensen
3,722,379 A 3/1973 Koester
3,742,669 A 7/1973 Mansfeld
3,760,547 A 9/1973 Brenneman
3,760,548 A 9/1973 Sauer et al.
3,778,954 A 12/1973 Meserole
3,849,235 A 11/1974 Gwynne
3,919,820 A 11/1975 Green
3,950,915 A 4/1976 Cole
4,007,994 A 2/1977 Brown
4,030,852 A 6/1977 Hein
4,064,571 A 12/1977 Phipps
4,080,086 A 3/1978 Watson
4,082,129 A 4/1978 Morelock
4,100,710 A 7/1978 Kowallik
4,107,892 A 8/1978 Bellem
4,113,399 A 9/1978 Hansen, Sr. et al.
4,169,688 A 10/1979 Toshio
4,196,554 A 4/1980 Anderson
4,227,430 A 10/1980 Jansson et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,648,165 A 3/1987 Whitehorse
5,007,222 A 4/1991 Raymond
5,071,282 A 12/1991 Brown
5,148,850 A 9/1992 Urbanick
5,173,012 A 12/1992 Ortwein et al.
5,182,892 A 2/1993 Chase
5,247,773 A 9/1993 Weir
5,272,850 A * 12/1993 Mysliwiec et al. ..... 52/582.2
5,344,700 A 9/1994 McGath et al.
5,348,778 A 9/1994 Knipp et al.
5,465,546 A 11/1995 Buse
5,485,702 A 1/1996 Sholton
5,548,937 A 8/1996 Shimonohara
5,598,682 A 2/1997 Haughian
5,618,602 A 4/1997 Nelson
5,634,309 A 6/1997 Polen
5,658,086 A 8/1997 Brokaw et al.
5,671,575 A 9/1997 Wu
5,694,730 A 12/1997 Del Rincon et al.
5,755,068 A 5/1998 Ormiston
5,899,038 A 5/1999 Stroppiana
5,950,389 A 9/1999 Porter
5,970,675 A * 10/1999 Schray ..... 52/582.1
6,006,486 A 12/1999 Moriau
6,029,416 A 2/2000 Andersson
6,052,960 A 4/2000 Yonemura
6,065,262 A 5/2000 Motta
6,173,548 B1 1/2001 Hamar et al.
6,182,410 B1 2/2001 Pervan
6,216,409 B1 4/2001 Roy et al.
6,314,701 B1 11/2001 Meyerson
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,490,836 B1 12/2002 Moriau et al.
6,505,452 B1 1/2003 Hannig
6,553,724 B1 4/2003 Bigler
6,591,568 B1 7/2003 Pålsson
6,601,359 B2 8/2003 Olofsson
6,617,009 B1 9/2003 Chen et al.
6,647,689 B2 11/2003 Pletzer
6,647,690 B1 11/2003 Martensson
6,651,400 B1 11/2003 Murphy
6,670,019 B2 12/2003 Andersson
6,685,391 B1 2/2004 Gideon
6,763,643 B1 7/2004 Martensson
6,766,622 B1 7/2004 Thiers
6,769,219 B2 8/2004 Schwitte et al.
6,769,835 B2 8/2004 Stridsman
6,804,926 B1 10/2004 Eisermann
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,137,229 B2 11/2006 Pervan
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 11/2008 Pervan et al.
7,516,588 B2 4/2009 Pervan
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,654,055 B2 * 2/2010 Ricker ..... 52/592.1
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,039 B2 7/2011 Groeke
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan

(56) References Cited

U.S. PATENT DOCUMENTS

| | | | |
|---|---|---|---|
| 8,181,416 | B2 | 5/2012 | Pervan et al. |
| 8,234,830 | B2 | 8/2012 | Pervan et al. |
| 8,302,367 | B2 | 11/2012 | Schulte |
| 8,336,272 | B2 | 12/2012 | Prager et al. |
| 8,341,914 | B2 | 1/2013 | Pervan et al. |
| 8,341,915 | B2 | 1/2013 | Pervan et al. |
| 8,353,140 | B2 | 1/2013 | Pervan et al. |
| 8,359,805 | B2 | 1/2013 | Pervan et al. |
| 8,381,477 | B2 | 2/2013 | Pervan et al. |
| 8,387,327 | B2 | 3/2013 | Pervan |
| 8,448,402 | B2 | 5/2013 | Pervan et al. |
| 2001/0024707 | A1 | 9/2001 | Andersson et al. |
| 2002/0031646 | A1 | 3/2002 | Chen et al. |
| 2002/0046433 | A1 | 4/2002 | Sellman, Jr. et al. |
| 2002/0069611 | A1 | 6/2002 | Leopolder |
| 2002/0100231 | A1 | 8/2002 | Miller et al. |
| 2002/0170259 | A1 | 11/2002 | Ferris |
| 2002/0178674 | A1 | 12/2002 | Pervan |
| 2002/0178680 | A1 | 12/2002 | Martensson |
| 2003/0009971 | A1 | 1/2003 | Palmberg |
| 2003/0024199 | A1 | 2/2003 | Pervan et al. |
| 2003/0037504 | A1 | 2/2003 | Schwitte et al. |
| 2003/0084636 | A1 | 5/2003 | Pervan |
| 2003/0094230 | A1 | 5/2003 | Sjoberg |
| 2003/0101681 | A1 | 6/2003 | Tychsen |
| 2003/0154676 | A1 | 8/2003 | Schwartz |
| 2003/0180091 | A1 | 9/2003 | Stridsman |
| 2003/0188504 | A1 | 10/2003 | Ralf |
| 2003/0196405 | A1 | 10/2003 | Pervan |
| 2004/0031227 | A1 | 2/2004 | Knauseder |
| 2004/0049999 | A1 | 3/2004 | Krieger |
| 2004/0060255 | A1 | 4/2004 | Knauseder |
| 2004/0068954 | A1 | 4/2004 | Martensson |
| 2004/0107659 | A1 | 6/2004 | Glockl |
| 2004/0123548 | A1* | 7/2004 | Gimpel et al. ..... 52/582.1 |
| 2004/0128934 | A1 | 7/2004 | Hecht |
| 2004/0139676 | A1 | 7/2004 | Knauseder |
| 2004/0139678 | A1 | 7/2004 | Pervan |
| 2004/0168392 | A1 | 9/2004 | Konzelmann et al. |
| 2004/0177584 | A1 | 9/2004 | Pervan |
| 2004/0182033 | A1 | 9/2004 | Wernersson |
| 2004/0182036 | A1 | 9/2004 | Sjoberg et al. |
| 2004/0200175 | A1 | 10/2004 | Weber |
| 2004/0211143 | A1 | 10/2004 | Hannig |
| 2004/0250492 | A1 | 12/2004 | Becker |
| 2004/0255541 | A1 | 12/2004 | Thiers |
| 2004/0261348 | A1 | 12/2004 | Vulin |
| 2005/0028474 | A1 | 2/2005 | Kim |
| 2005/0050827 | A1 | 3/2005 | Schitter |
| 2005/0138881 | A1 | 6/2005 | Pervan |
| 2005/0160694 | A1 | 7/2005 | Pervan |
| 2005/0166514 | A1 | 8/2005 | Pervan |
| 2005/0210810 | A1 | 9/2005 | Pervan |
| 2005/0235593 | A1 | 10/2005 | Hecht |
| 2006/0070333 | A1 | 4/2006 | Pervan |
| 2006/0099386 | A1 | 5/2006 | Smith |
| 2006/0101769 | A1 | 5/2006 | Pervan et al. |
| 2006/0156670 | A1 | 7/2006 | Knauseder |
| 2006/0236642 | A1 | 10/2006 | Pervan |
| 2006/0260254 | A1 | 11/2006 | Pervan |
| 2007/0006543 | A1 | 1/2007 | Engstrom |
| 2007/0028547 | A1* | 2/2007 | Grafenauer et al. ..... 52/586.1 |
| 2007/0065293 | A1 | 3/2007 | Hannig |
| 2007/0108679 | A1 | 5/2007 | Grothaus |
| 2007/0151189 | A1 | 7/2007 | Yang et al. |
| 2007/0175143 | A1 | 8/2007 | Pervan et al. |
| 2007/0175156 | A1 | 8/2007 | Pervan et al. |
| 2007/0193178 | A1 | 8/2007 | Groeke et al. |
| 2007/0209736 | A1 | 9/2007 | Deringor et al. |
| 2008/0000185 | A1 | 1/2008 | Duernberger |
| 2008/0005989 | A1 | 1/2008 | Pervan et al. |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0034708 | A1 | 2/2008 | Pervan |
| 2008/0041008 | A1 | 2/2008 | Pervan |
| 2008/0066415 | A1 | 3/2008 | Pervan |
| 2008/0104921 | A1 | 5/2008 | Pervan et al. |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0155930 | A1 | 7/2008 | Pervan et al. |
| 2008/0172971 | A1 | 7/2008 | Pervan |
| 2008/0216434 | A1 | 9/2008 | Pervan |
| 2008/0216920 | A1 | 9/2008 | Pervan |
| 2008/0236088 | A1 | 10/2008 | Hannig et al. |
| 2008/0263975 | A1 | 10/2008 | Mead |
| 2008/0295432 | A1 | 12/2008 | Pervan et al. |
| 2009/0019806 | A1 | 1/2009 | Muehlebach |
| 2009/0100782 | A1 | 4/2009 | Groeke et al. |
| 2009/0133353 | A1 | 5/2009 | Pervan et al. |
| 2009/0151290 | A1 | 6/2009 | Liu |
| 2009/0155612 | A1 | 6/2009 | Pervan et al. |
| 2009/0193741 | A1 | 8/2009 | Cappelle |
| 2009/0193748 | A1 | 8/2009 | Boo et al. |
| 2009/0193753 | A1 | 8/2009 | Schitter |
| 2009/0308014 | A1 | 12/2009 | Muehlebach |
| 2010/0043333 | A1 | 2/2010 | Hannig et al. |
| 2010/0083603 | A1 | 4/2010 | Goodwin |
| 2010/0173122 | A1 | 7/2010 | Susnjara |
| 2010/0293879 | A1 | 11/2010 | Pervan et al. |
| 2010/0300030 | A1 | 12/2010 | Pervan et al. |
| 2010/0300031 | A1 | 12/2010 | Pervan et al. |
| 2010/0319291 | A1 | 12/2010 | Pervan et al. |
| 2011/0016815 | A1 | 1/2011 | Yang |
| 2011/0030303 | A1 | 2/2011 | Pervan et al. |
| 2011/0041996 | A1 | 2/2011 | Pervan |
| 2011/0088344 | A1 | 4/2011 | Pervan et al. |
| 2011/0088345 | A1 | 4/2011 | Pervan |
| 2011/0131916 | A1 | 6/2011 | Chen |
| 2011/0154763 | A1 | 6/2011 | Bergelin et al. |
| 2011/0167750 | A1 | 7/2011 | Pervan |
| 2011/0167751 | A1 | 7/2011 | Engstrom |
| 2011/0197535 | A1* | 8/2011 | Baker et al. ..... 52/588.1 |
| 2011/0225922 | A1 | 9/2011 | Pervan et al. |
| 2011/0252733 | A1 | 10/2011 | Pervan |
| 2011/0271632 | A1 | 11/2011 | Cappelle et al. |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0124932 | A1 | 5/2012 | Schulte et al. |
| 2012/0151865 | A1 | 6/2012 | Pervan et al. |
| 2012/0174515 | A1 | 7/2012 | Pervan |
| 2012/0174520 | A1 | 7/2012 | Pervan |
| 2012/0174521 | A1 | 7/2012 | Schulte et al. |
| 2012/0192521 | A1 | 8/2012 | Schulte |
| 2012/0279161 | A1 | 11/2012 | Håkansson et al. |
| 2013/0014463 | A1 | 1/2013 | Pervan |
| 2013/0019555 | A1 | 1/2013 | Pervan |
| 2013/0042562 | A1 | 2/2013 | Pervan |
| 2013/0042563 | A1 | 2/2013 | Pervan |
| 2013/0042564 | A1 | 2/2013 | Pervan |
| 2013/0042565 | A1 | 2/2013 | Pervan |
| 2013/0047536 | A1 | 2/2013 | Pervan |
| 2013/0055950 | A1 | 3/2013 | Pervan |
| 2013/0081349 | A1 | 4/2013 | Pervan et al. |
| 2013/0111845 | A1 | 5/2013 | Pervan |
| 2013/0145708 | A1 | 6/2013 | Pervan |

FOREIGN PATENT DOCUMENTS

| | | | |
|---|---|---|---|
| DE | 39 32 980 | A1 | 11/1991 |
| DE | 299 22 649 | U1 | 4/2000 |
| DE | 199 40 837 | A1 | 11/2000 |
| DE | 199 58 225 | A1 | 6/2001 |
| DE | 202 06 460 | U1 | 7/2002 |
| DE | 202 05 774 | U1 | 8/2002 |
| DE | 203 20 799 | U1 | 4/2005 |
| DE | 10 2004 055 951 | A1 | 7/2005 |
| DE | 10 2004 001 363 | A1 | 8/2005 |
| DE | 10 2004 054 368 | A1 | 5/2006 |
| DE | 10 2005 024 366 | A1 | 11/2006 |
| DE | 10 2006 024 184 | A1 | 11/2007 |

(56) References Cited

FOREIGN PATENT DOCUMENTS

| | | | |
|---|---|---|---|
| DE | 10 2006 037 614 | B3 | 12/2007 |
| DE | 10 2006 057 491 | A | 6/2008 |
| DE | 10 2007 018 309 | A1 | 8/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 048 050 | B3 | 1/2011 |
| EP | 0 013 852 | A1 | 8/1980 |
| EP | 0 871 156 | A2 | 10/1998 |
| EP | 0 974 713 | A1 | 1/2000 |
| EP | 1 308 577 | A2 | 5/2003 |
| EP | 1 350 904 | A2 | 10/2003 |
| EP | 1 350 904 | A3 | 10/2003 |
| EP | 1 357 239 | A2 | 10/2003 |
| EP | 1 357 239 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 017 403 | A2 | 1/2009 |
| FR | 1138595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-288017 | A | 10/1994 |
| JP | 6-306961 | A | 11/1994 |
| JP | 6-322848 | A | 11/1994 |
| JP | 7-300979 | A | 11/1995 |
| JP | 8-086080 | A | 4/1996 |
| WO | WO 94/26999 | A1 | 11/1994 |
| WO | WO 97/47834 | A1 | 12/1997 |
| WO | WO 98/22677 | A1 | 5/1998 |
| WO | WO 00/20705 | A1 | 4/2000 |
| WO | WO 00/43281 | A1 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02672 | A1 | 1/2001 |
| WO | WO 01/48332 | A1 | 7/2001 |
| WO | WO 01/51732 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/98604 | A1 | 12/2001 |
| WO | WO 02/48127 | | 6/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/078761 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/053257 | A1 | 6/2004 |
| WO | WO 2004/053257 | A8 | 6/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2007/015669 | A2 | 2/2007 |
| WO | WO 2007/079845 | A1 | 7/2007 |
| WO | WO 2007/089186 | A1 | 8/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2009/116926 | A1 | 9/2009 |
| WO | WO 2010/070472 | A2 | 6/2010 |
| WO | WO 2010/070605 | A2 | 6/2010 |
| WO | WO 2010/087752 | A1 | 8/2010 |
| WO | WO 2010/108980 | A1 | 9/2010 |
| WO | WO 2010/136171 | A1 | 12/2010 |
| WO | WO 2011/001326 | A2 | 1/2011 |
| WO | WO 2011/012104 | A2 | 2/2011 |
| WO | WO 2011/032540 | A2 | 3/2011 |
| WO | WO 2011/127981 | A1 | 10/2011 |
| WO | WO 2011/151758 | A2 | 12/2011 |

OTHER PUBLICATIONS

U.S. Appl. No. 13/544,281, Pervan.
U.S. Appl. No. 13/546,569, Pervan.
U.S. Appl. No. 13/585,204, Pervan.
U.S. Appl. No. 13/585,485, Pervan.
U.S. Appl. No. 13/585,179, Pervan.
U.S. Appl. No. 13/596,988, Pervan.
U.S. Appl. No. 13/660,538, Pervan, et al.
U.S. Appl. No. 13/670,039, Pervan, et al.
U.S. Appl. No. 13/728,121, Pervan, et al.
U.S. Appl. No. 60/620,233, Boo.
U.S. Appl. No. 61/620,246, Boo.
Pervan, Darko, et al., U.S. Appl. No. 13/577,042, entitled "Mechanical Locking System for Floor Panels," filed in the U.S. Patent and Trademark Office on Aug. 3, 2012.
Pervan, Darko, U.S. Appl. No. 13/544,281, entitled "Mechanical Locking System for Floor Panels," filed in the U.S. Patent and Trademark Office on Jul. 9, 2012.
Pervan, Darko, et al., U.S. Appl. No. 13/546,569, entitled "Mechanical Locking System for Floor Panels," filed in the U.S. Patent and Trademark Office on Jul. 11, 2012.
Pervan, Darko, et al., U.S. Appl. No. 13/585,204, entitled "Mechanical Locking System for Floor Panels," filed in the U.S. Patent and Trademark Office on Aug. 14, 2012.
Pervan, Darko, et al., U.S. Appl. No. 13/585,485, entitled "Mechanical Locking System for Floor Panels," filed in the U.S. Patent and Trademark Office on Aug. 14, 2012.
Pervan, Darko, et al., U.S. Appl. No. 13/585,179, entitled, "Mechanical Locking System for Floor Panels," filed in the U.S. Patent and Trademark Office on Aug. 14, 2012.
Pervan, Darko, et al., U.S. Appl. No. 13/596,988, entitled, "Mechanical Locking System for Floor Panels," filed in the U.S. Patent and Trademark Office on Aug. 28, 2012.
Pervan, Darko, et al., U.S. Appl. No. 13/660,538, entitled "Mechanical Locking of Floor Panels with Vertical Snap Folding," filed in the U.S. Patent and Trademark Office on Oct. 25, 2012.
Pervan, Darko, et al., U.S. Appl. No. 13/670,039, entitled "Mechanical Locking of Floor Panels with a Flexible Tongue," filed in the U.S. Patent and Trademark Office on Nov. 6, 2012.
Pervan, Darko, et al., U.S. Appl. No. 13/728,121, entitled "Mechanical Locking of Floor Panels with a Flexible Tongue," filed in the U.S. Patent and Trademark Office on Dec. 27, 2012.
Boo, Christian, U.S. Appl. No. 61/620,233, entitled "Building Panel with a Mechanical Locking System," filed in the U.S. Patent and Trademark Office on Apr. 4, 2012.
Boo, Christian, U.S. Appl. No. 61/620,246, entitled "Method for Producing a Mechanical Locking System for Building Panels," filed in the U.S. Patent and Trademark Office on Apr. 4, 2012.
Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

(56) References Cited

OTHER PUBLICATIONS

Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.
Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP com No. IPCOM000203832D, Feb. 4, 2011, IP.com Prior Art Database, 22 pages.
Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
Pervan, Darko, et al., U.S. Appl. No. 13/758,603, entitled "Mechanical Locking System for Panels and Method of Installing Same," filed in the U.S. Patent and Trademark Office Feb. 4, 2013.
U.S. Appl. No. 13/855,966, Boo.
U.S. Appl. No. 13/855,979, Boo et al.
Boo, Christian, U.S. Appl. No. 13/855,966, entitled "Building Panel with a Mechanical Locking System," filed in the U.S. Patent and Trademark Office on Apr. 3, 2013.
Boo, Christian, et al., U.S. Appl. No. 13/855,979, entitled "Method for Producing a Mechanical Locking System for Building Panels," filed in the U.S. Patent and Trademark Office on Apr. 3, 2013.
International Search Report mailed Nov. 19, 2012 in PCT/SE2012/050764, Swedish Patent Office, Stockholm, Sweden, 9 pages.
U.S. Appl. No. 13/886,916, Pervan et al.
Pervan, Darko, et al., U.S. Appl. No. 13/886,916, entitled "Mechanical Locking of Building Panels," filed in the U.S. Patent and Trademark Office on May 3, 2013.
Pervan, Darko, et al., U.S. Appl. No. 13/962,446 entitled "Mechanical Locking System for Floor Panels," filed in the U.S. Patent and Trademark Office on Aug. 8, 2013.
Pervan, Darko, U.S. Appl. No. 14/011,042 entitled "Mechanical Locking System for Floor Panels," filed in the U.S. Patent and Trademark Office on Aug. 27, 2013.
Pervan, Darko, et al., U.S. Appl. No. 14/011,121 entitled "Mechanical Locking System for Floor Panels with Vertical Snap Folding," filed in the U.S. Patent and Trademark Office on Aug. 27, 2013.

* cited by examiner

MECHANICAL LOCKING OF FLOOR PANELS WITH A GLUED TONGUE

CROSS REFERENCE TO RELATED APPLICATIONS

The present application claims the benefit of U.S. Provisional Application No. 61/504,576, filed on 5 Jul. 2011, Swedish Application No. 1150635-9, filed on 5 Jul. 2011, Swedish Application No. 1150775-3, filed on 26 Aug. 2011, and Swedish Application No. 1150777-9, filed on 29 Aug. 2011. The entire contents of each of U.S. Provisional Application No. 61/504,576, Swedish Application No. 1150635-9, Swedish Application No. 1150775-3, and Swedish Application No. 1150777-9 are hereby incorporated herein by reference in their entirety.

AREA OF INVENTION

The invention generally relates to the field of floor panels with mechanical locking systems with a flexible and displaceable tongue. The invention also relates to a partly bendable tongue for a building panel with such a mechanical locking system.

BACKGROUND OF THE INVENTION

In particular, yet not restrictive manner, the invention concerns a tongue for a floor panel and a set of floor panels mechanically joined to preferably a floating floor. However, the invention is applicable to building panels in general as well. More particularly invention relates to the type of mechanically locking system that comprises a flexible or partly flexible tongue and/or displaceable tongue, in order to facilitate the installation of building panels.

A floor panel of this type is presented in WO 2006/043893, which discloses a floor panel with a locking system comprising a locking element cooperating with a locking groove, for horizontal locking, and a flexible tongue cooperating with a tongue groove, for locking in a vertical direction. The flexible tongue, which may be made of plastic, bends in the horizontal plane and is displaced in a groove during connection of two floor panels. The flexible tongue allows the floor panels to be installed by vertical folding or solely by vertical movement.

The flexible tongues are generally connected into a groove with friction connections. One disadvantage with such connection is that the tongue may fall out from the groove when floor panels swell or shrink or when the groove is not made with sufficient tolerances.

It is known that the tongue may be glued into the groove. The problem is that it is difficult to glue plastic to wood and that part of the glue also glues the tongue in such a way that it cannot be displaced during the connection of the floor panels. The present invention provides a simple way to glue a flexible and displaceable tongue into a groove.

SUMMARY OF THE INVENTION

The aim of present invention is to provide a tongue that is easy to glue in a groove. Useful areas for the invention are floor panels, preferably to be installed floating, of any shape and material e.g. laminate, wood, HDF, veneer or stone. However, the invention is applicable to building panels in general.

The tongue may be used in any mechanical locking system that facilitates the assembling of building panels. The tongue may be used in the mechanical locking system for vertical locking of two adjacent floor panels. The locking system may further comprise additional elements for horizontal locking of the adjacent floor panels.

A first aspect of the invention is a tongue for connection of a building panel, said tongue is of an elongated shape and made of moulded plastic. The tongue comprises protrusions, preferably bow shaped, at a first long edge of the tongue. The protrusions are bendable in a plane parallel to the upper surface of the tongue and extending essentially in the parallel plane. The tongue has a second long edge, which is essentially straight over substantially the whole length of the tongue. The tongue comprises a gluing part configured to be glued into a groove at an edge of the building panel.

The gluing part may be an edge section, which is spaced in the length direction of the tongue from the protrusions.

The edge section may comprise a glue pocket.

The edge section may comprise a flexible link that connects the edge section to the main tongue body.

The tongue may be provided with said edge sections at each edge of the tongue.

The advantage is that the edge sections are spaced from the main tongue body that is displaced during locking. The risk that glue will be applied in the part of the groove where the tongue has to be displaceable is eliminated.

The edge section may be provided with a breaking part, configured to be broken when the tongue is inserted into the groove.

The edge section may be provided with an outer protruding stop part, which overlaps an inner stop part, which protrudes from the edge of the tongue, wherein said inner and outer stop part cooperates to limit the displacement of the tongue in the groove.

The edge section may be provided with a protruding friction connection, configured to hold the tongue in the correct position until the glue is cured.

The gluing part may be a gluing strip extending in the longitudinal direction of the tongue, preferably along substantially the whole length of the tongue, and wherein the gluing strip is attached to the outer end of some of the protrusions.

The advantage with such a gluing strip is that the tongue is attached steady to the groove of the building panel and with an improved position tolerance. It is also easier to provide the glue along the bottom of the groove, which is made possible by this embodiment.

The outer end of the protrusions, at a first edge of the tongue, may be free and not attached to the gluing strip.

The outer end of the protrusions, at a second edge of the tongue, may be attached to the gluing strip.

The outer end of the protrusions may be provided with a thinner section for facilitating the bending of the protrusion.

The outer end of the gluing strip may be provided with a bow shaped part for facilitating the insertion of the tongue into the groove.

There may be an angle between the protrusions and the longitudinal direction of the tongue.

A second aspect of the invention is a building panel provided with a tongue, according to the first aspect, in a sidewardly open groove at edge of the panel.

BRIEF DESCRIPTION OF THE DRAWINGS

The disclosure will in the following be described in connection to exemplary embodiments and in greater detail with reference to the appended exemplary drawings, wherein.

DESCRIPTION OF EMBODIMENTS OF THE INVENTION

Figure 1:
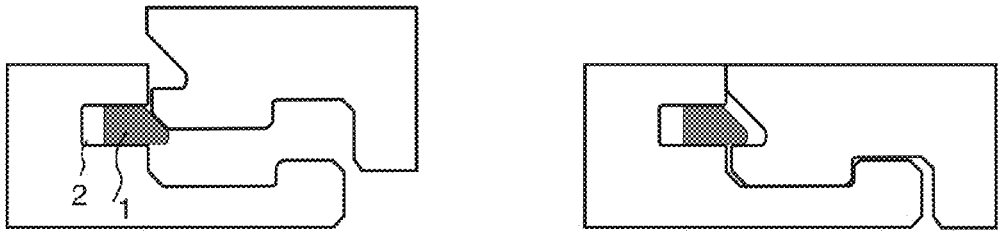
FIG. 1 illustrate a known locking system comprising a displaceable tongue.

FIG. 1 shows a vertical locking of two panels where a flexible and displaceable tongue 1 is displaced in a fixing groove 2.

Figure 2:
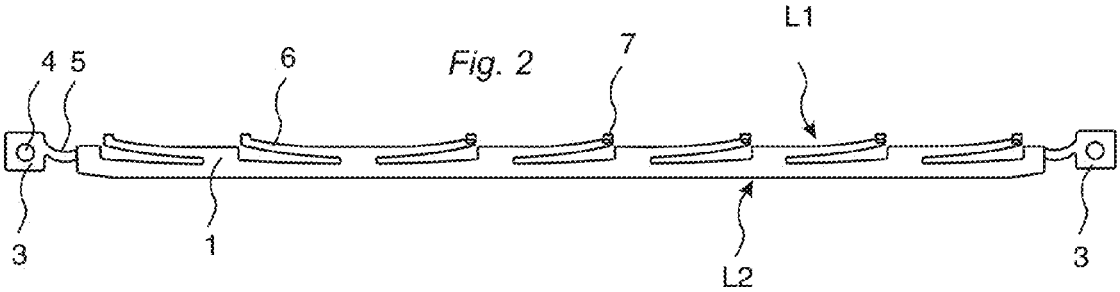
FIG. 2 shows a first embodiment of the tongue according to the invention.

FIG. 2 shows a first embodiment of a flexible tongue 1, made of moulded plastic material, which comprises two edge sections 3, which are intended to be used to glue the tongue into a groove 2.

The tongue is of an elongated shape and comprising in this preferred embodiment at least two protrusions 6 at a first long edge L1.

The protrusions are bendable in a plane parallel to the upper surface of the tongue and extending essentially in the parallel plane.

The tongue has a second long edge L2, which is essentially straight over substantially the whole length of the tongue.

The edge section 3 comprises a glue pocket 4 where glue is applied, preferably by an inserting equipment, which also positions the tongue into a groove of a panel. Friction connections 7 may be used to hold the tongue in the groove until the glue cures.

Figure 3A:
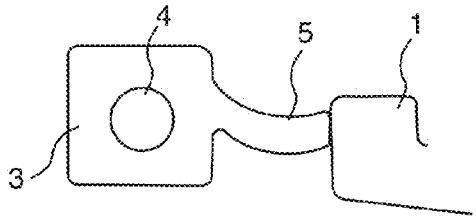
FIGS. 3*a* and 3*b* shows an edge section of the first embodiment of the tongue.
Figure 3B:
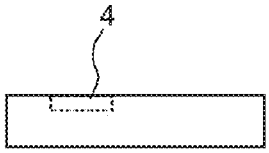

FIG. 3*a* shows the edge section from above. FIG. 3*b* shows a cross section of the edge section. A glue pocket 4 is preferably formed as a local cavity.

The edge section is connected to the main tongue body with a flexible link 5 that allow the tongue to move in the groove 2 and in relation to the edge section 3 that is glued into a groove 2. A wide variety of glues may be used, preferably hot melt based glues.

Figure 4:
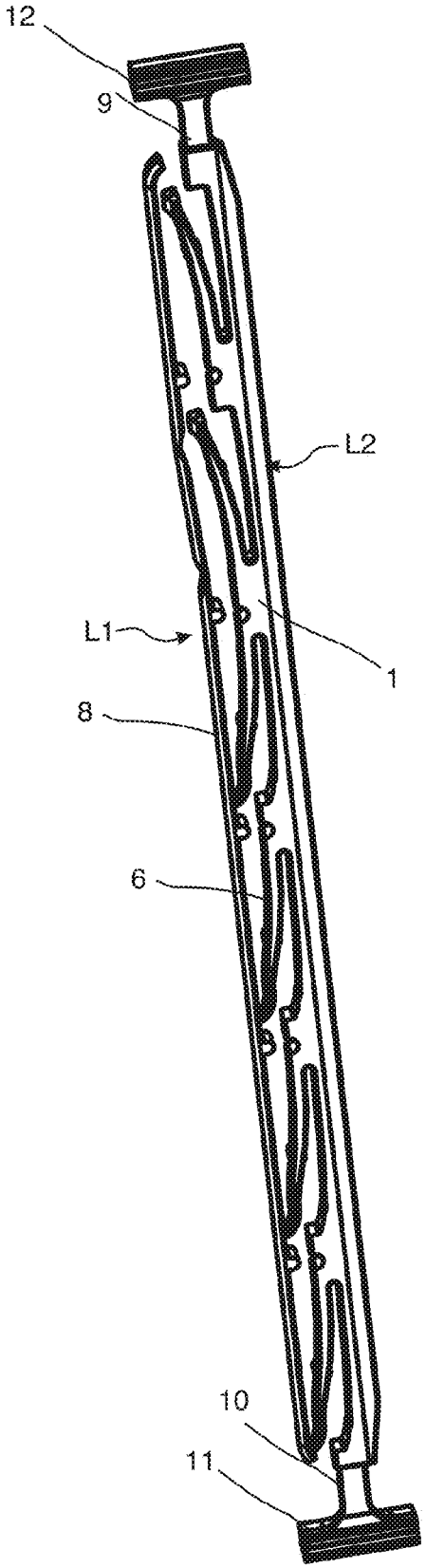
FIG. 4 shows a second embodiment of the tongue.

FIG. 4 shows a second embodiment of a flexible tongue 1, made of moulded plastic material, which is provided with a gluing strip 8 configured to be used to glue the tongue into a groove 2. Parts 11, 12 formed by moulding inlets from a moulding tool are shown at the first 9 and the second edge 10 of the tongue 1. These parts are used to facilitate the insertion of the tongue into a groove 2 of a building panel, preferably a floor panel.

The tongue is of an elongated shape and comprising in the second embodiment at least two protrusions 6 at a first long edge L1.

The protrusions are bendable in a plane parallel to the upper surface of the tongue and extending essentially in the parallel plane.

The tongue has a second long edge L2, which is essentially straight over substantially the whole length of the tongue.

Figure 5:
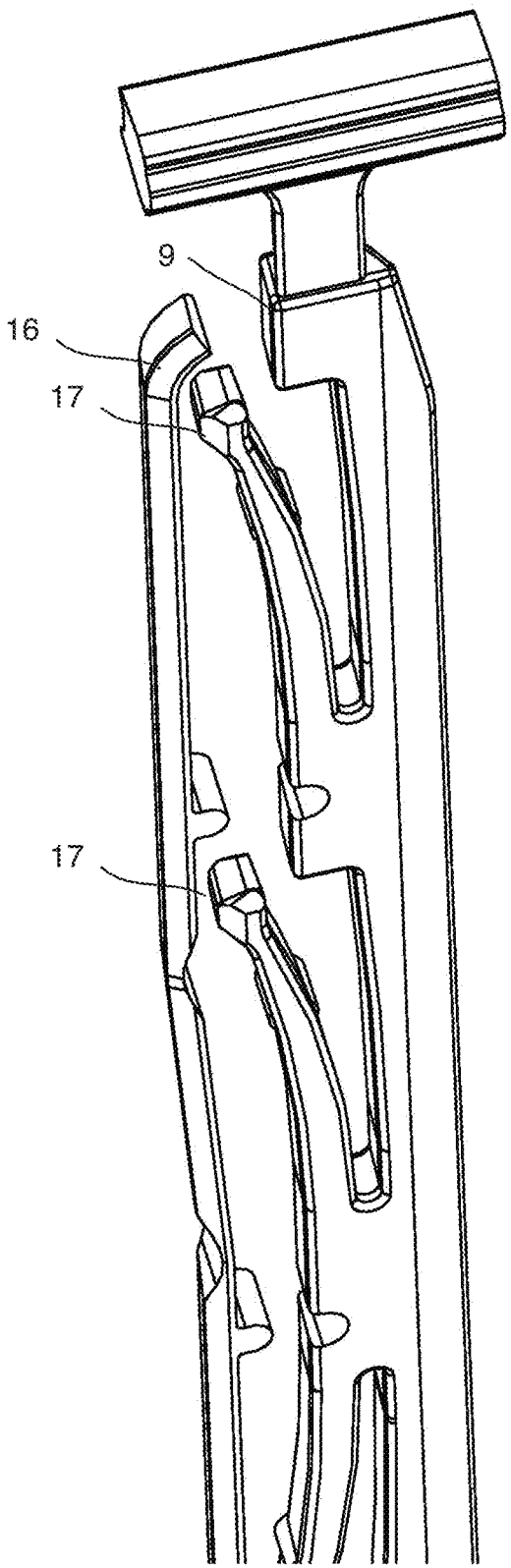
FIG. 5 shows first edge section of the second embodiment.

FIG. 5 shows the first edge 9 of second embodiment of the tongue. The outer ends 17 of the protrusions 6 at the first edge are free from the gluing strip 8 to facilitate a movement of the second long edge L2 along the groove 2 of the building panel. The outer part of the gluing strip is bow shaped 16 to facilitate insertion of the tongue into the groove 2 of the building panel.

Figure 6:
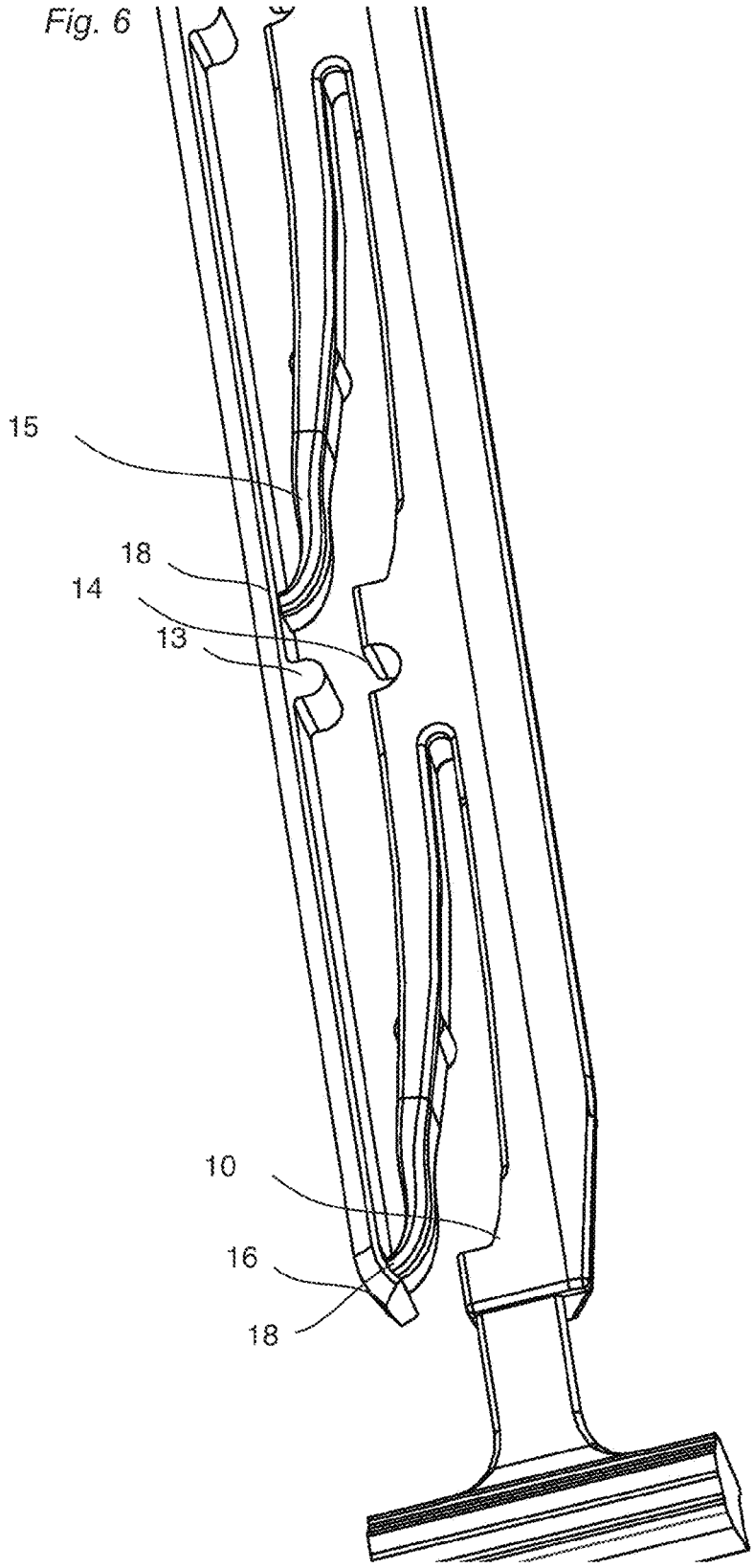
FIG. 6 shows second edge section of the second embodiment.

FIG. 6 shows the second edge 10 of second embodiment of the tongue 1. The outer ends 18 of the protrusions 6 at the second edge are attached to the gluing strip 8. The outer part 16 of the gluing strip is bow shaped to facilitate insertion of the tongue into the groove 2 of the building panel.

The outer ends of the protrusions are provided with a thinner section 15 to improve the bending of the tongue.

The gluing strip is provided with a protrusion 13, which makes it easier to remove the tongue from the moulding tool. The tongue body is provided with an aperture 14 adapted to the size of the gluing strip protrusion 13, which make it possible to push the second long edge L2 of the tongue 1 further into the groove 2 of the building panel.

Figure 7:
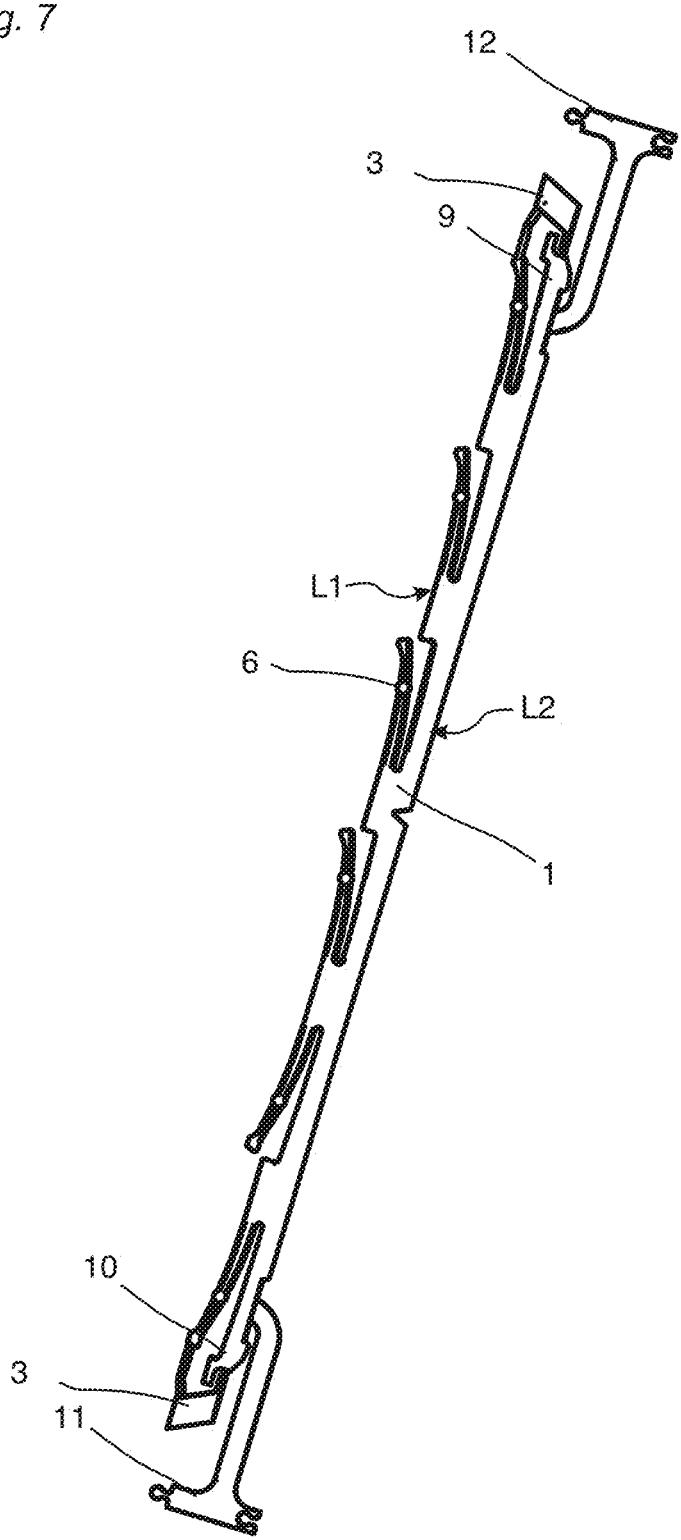
FIG. 7 shows a third embodiment of the tongue.

FIG. 7 shows a third embodiment of a flexible tongue 1, made of moulded plastic material, which is provided with an edge sections 3 configured to be used to glue the tongue into a groove 2. The tongue has a second long edge L2, which is essentially straight over substantially the whole length of the tongue. The tongue is of an elongated shape and comprising in the second embodiment at least two protrusions 6 at a first long edge L1.

Parts 11, 12 formed by moulding inlets from a moulding tool are shown at the first 9 and the second edge 10 of the tongue 1. These parts are used to facilitate the insertion of the tongue into a groove 2 of a building panel, preferably a floor panel.

The protrusions are bendable in a plane parallel to the upper surface of the tongue and extending essentially in the parallel plane.

Figure 8:
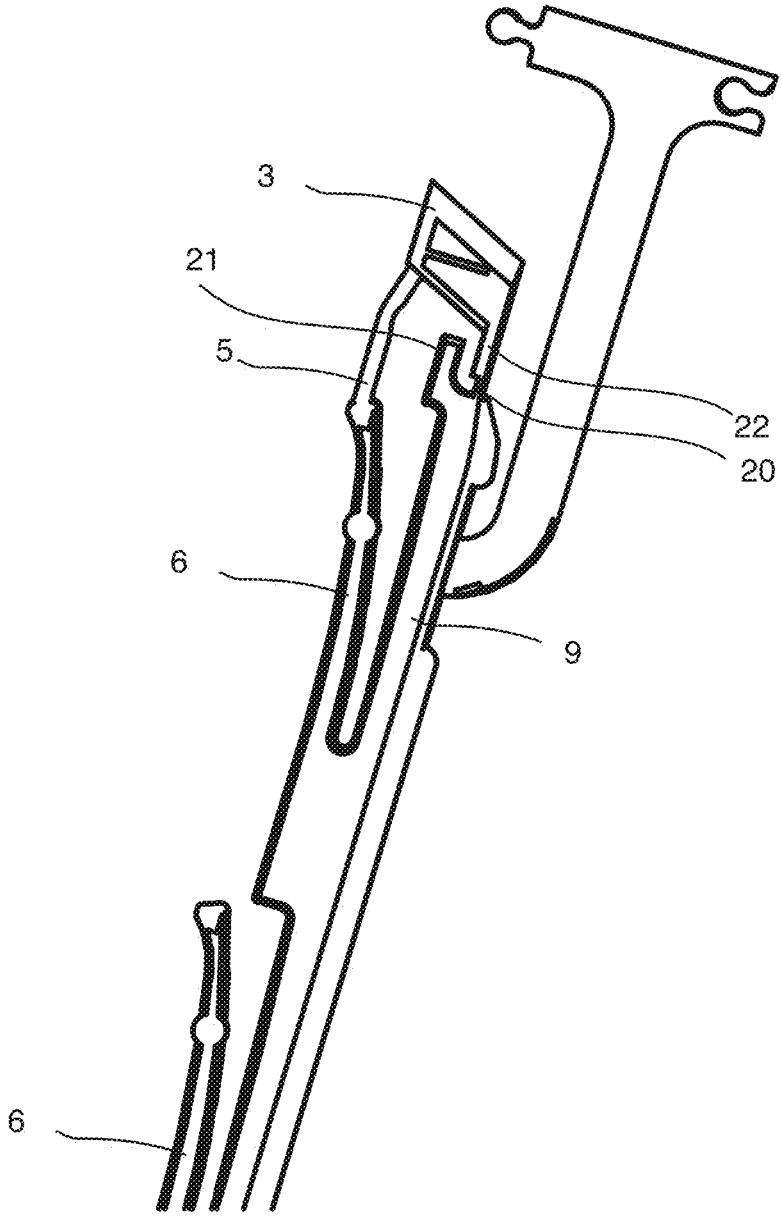
FIG. 8 shows first edge section of the third embodiment.

FIG. 8 shows the first edge 9 of the third embodiment of the tongue.

Figure 9:
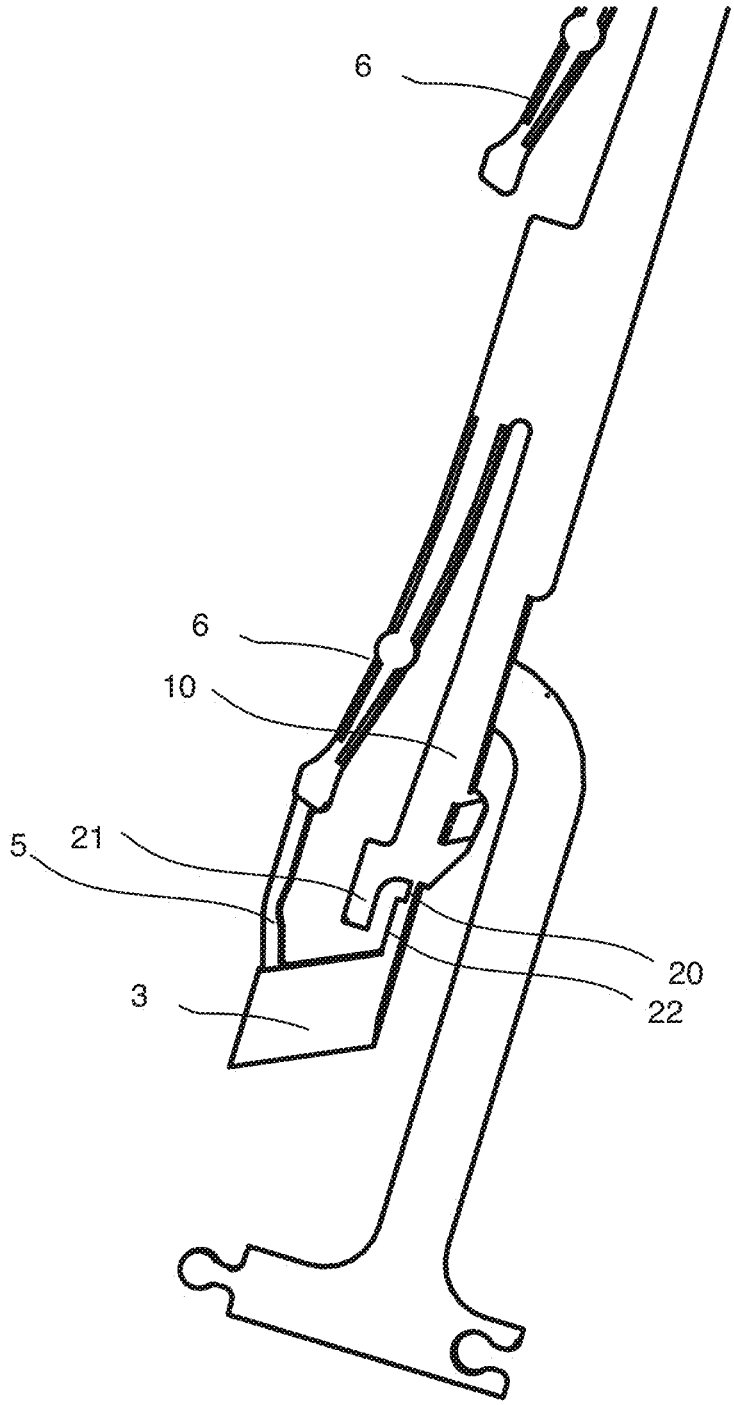
FIG. 9 shows second edge section of the third embodiment.

FIG. 9 shows the second edge 10 of the third embodiment of the tongue 1.

The third embodiment of the tongue is provided with said edge sections 3 on each edge of the tongue. Said edge section is provided with a protruding friction connection, configured to hold the tongue in the correct position until the glue is cured. A flexible link 5 connects the edge section 3 to the main tongue body.

The edge sections are each provided with an outer protruding stop part 22, which overlap an inner stop part 21, which protrudes from each edge 9, 10 of the tongue, wherein said inner and outer stop part cooperates to limit the displacement of the tongue 1 in the groove 2.

The edge sections are further provided with a breaking part 20, configured to be broken when the tongue 1 is inserted into the groove 2.

Glue may be used that glues to a wood based material and cures such that a part of the glue will form a small protrusion in the glue pocket and will connect the tongue mechanically even if the glue as such cannot glue the plastic material that is used to form the tongue.

The principles shown above may be used to connect all types of tongues that are intended to be displaceable in a groove. Even tongues that are not flexible and displaceable may be connected according to the described principles.

The invention claimed is:

1. A tongue for connection of a building panel, said tongue is of an elongated shape and made of moulded plastic, the tongue comprising at least two protrusions at a first long edge of the tongue, wherein the protrusions are bendable in a plane parallel to the upper surface of the tongue and extend essentially in the parallel plane, wherein the tongue has a second long edge, which is essentially straight over substantially the whole length of the tongue, the tongue further comprising a gluing part configured to be glued into a groove at an edge of the building panel, wherein the gluing part is an edge section of the tongue, the edge section spaced from the protrusions in a length direction along the first long edge of the tongue such that at least one of the protrusions extends in a direction from the first long edge toward the gluing part, and wherein at least one of the protrusions is provided with a flexible link that connects the edge section to a body of the tongue.

2. The tongue as claimed in claim 1, wherein said edge section is provided with a breaking part, configured to be broken when the tongue is inserted into the groove.

3. The tongue as claimed in claim 1, wherein said edge section is provided with an outer protruding stop part, which overlaps an inner stop part, the inner stop part protruding from the edge of the body of the tongue, wherein said inner and outer stop parts cooperate to limit the displacement of the tongue in the groove.

4. The tongue as claimed in claim 1, wherein said edge section is provided with a protruding friction connection, configured to hold the tongue in the correct position until the glue is cured.

5. The tongue as claimed in claim 1, wherein a protrusion is provided with a protruding friction connection, configured to hold the tongue in the correct position until the glue is cured.

6. The tongue as claimed in claim 1, wherein the tongue is provided with an edge section on each edge of the tongue.

7. The tongue as claimed in claim 1, wherein the protrusions are bow shaped.

8. The tongue as claimed in claim 1, wherein there is an angle between the protrusions and the longitudinal direction of the tongue.

9. A building panel provided with a tongue, according to claim 1, wherein said tongue is displaceable in a groove at an edge of the building panel.

10. A tongue for connection of a building panel, said tongue is of an elongated shape and made of moulded plastic, the tongue comprising at least two protrusions at a first long edge of the tongue, wherein the protrusions are bendable in a plane parallel to the upper surface of the tongue and extend essentially in the parallel plane, wherein the tongue has a second long edge, which is essentially straight over substantially the whole length of the tongue, the tongue further comprising a gluing part configured to be glued into a groove at an edge of the building panel, wherein the gluing part is an edge section of the tongue, the edge section spaced from the protrusions in a length direction along the first long edge of the tongue, and wherein at least one of the protrusions is provided with a flexible link that extends from a distal-most tip of the at least one of the protrusions and connects the edge section to a body of the tongue.

11. The tongue as claimed in claim 10, wherein said edge section is provided with a breaking part, configured to be broken when the tongue is inserted into the groove.

12. The tongue as claimed in claim 10, wherein said edge section is provided with an outer protruding stop part, which overlaps an inner stop part, the inner stop part protruding from the edge of the body of the tongue, wherein said inner and outer stop parts cooperate to limit the displacement of the tongue in the groove.

13. The tongue as claimed in claim 10, wherein said edge section is provided with a protruding friction connection, configured to hold the tongue in the correct position until the glue is cured.

14. The tongue as claimed in claim 10, wherein a protrusion is provided with a protruding friction connection, configured to hold the tongue in position until the glue is cured.

15. A tongue for connection of a building panel, said tongue is of an elongated shape and made of moulded plastic, the tongue comprising at least two protrusions at a first long edge of the tongue, wherein the protrusions are bendable in a plane parallel to the upper surface of the tongue and extend essentially in the parallel plane, wherein the tongue has a second long edge, which is essentially straight over substantially the whole length of the tongue, the tongue further comprising a gluing part configured to be glued into a groove at an edge of the building panel, wherein the gluing part is an edge section of the tongue, the edge section spaced from the protrusions in a length direction along the first long edge of the tongue, at least one of the protrusions is provided with a flexible link that connects the edge section to a body of the tongue, and the gluing part is positioned more distally from a center portion of the tongue in the length direction along the first long edge of the tongue than a protrusion that is closest to the gluing part.

16. The tongue as claimed in claim 15, wherein said edge section is provided with a breaking part, configured to be broken when the tongue is inserted into the groove.

17. The tongue as claimed in claim 15, wherein said edge section is provided with an outer protruding stop part, which overlaps an inner stop part, the inner stop part protruding from the edge of the body of the tongue, wherein said inner and outer stop parts cooperate to limit the displacement of the tongue in the groove.

18. The tongue as claimed in claim 15, wherein said edge section is provided with a protruding friction connection, configured to hold the tongue in the correct position until the glue is cured.

19. The tongue as claimed in claim 15, wherein a protrusion is provided with a protruding friction connection, configured to hold the tongue in position until the glue is cured.

* * * * *